United States Patent [19]

Jachowski et al.

[11] Patent Number: 4,844,747

[45] Date of Patent: Jul. 4, 1989

[54] PROCESS OF PRODUCING A COMPOSITE ROLL

[75] Inventors: Johannes Jachowski, Duisburg; Paul Pant, Essen; Udo Riepe, Schwerte; Gerald Stein, Essen, all of Fed. Rep. of Germany

[73] Assignee: Fried. Krupp GmbH, Essen, Fed. Rep. of Germany

[21] Appl. No.: 197,269

[22] Filed: May 23, 1988

[30] Foreign Application Priority Data

May 22, 1987 [DE] Fed. Rep. of Germany ..... 3717257

[51] Int. Cl.[4] ..... B22D 27/02; C21D 9/38

[52] U.S. Cl. ..... 148/2; 148/3; 164/496; 164/497

[58] Field of Search ..... 164/496, 497, 76.1, 164/95, 91; 148/2, 3

[56] References Cited

U.S. PATENT DOCUMENTS

| | | | |
|---|---|---|---|
| 2,361,101 | 10/1944 | Hopkins | 164/515 |
| 3,109,235 | 11/1963 | Harris et al. | 164/496 X |
| 3,972,366 | 8/1976 | Dugan | 164/496 |
| 4,000,010 | 12/1976 | Sekimoto et al. | 148/3 |

FOREIGN PATENT DOCUMENTS

| | | | |
|---|---|---|---|
| 2906371 | 8/1980 | Fed. Rep. of Germany | 164/497 |
| 50-44121 | 4/1975 | Japan | 164/497 |
| 51-38233 | 3/1976 | Japan | 164/497 |
| 1230197 | 4/1971 | United Kingdom | 164/497 |
| 2036617A | 7/1980 | United Kingdom | 164/497 |

*Primary Examiner*—Nicholas P. Godici
*Assistant Examiner*—J. Reed Batten, Jr.
*Attorney, Agent, or Firm*—Spencer & Frank

[57] ABSTRACT

A process of manufacturing a roll suitable for use in a rolling mill, the roll having a cylindrical barrel middle section and a neck at each end of the barrel, wherein the barrel and necks are of different material compositions, by remelting an electrode having a central region corresponding in mass and composition of materials to that desired for the barrel of the roll, two end regions corresponding in mass and composition of materials to that desired for the necks of the roll and a transition region disposed between the central region and each end region, each transition region including the material of the barrel and at least one further material. An electroslag remelting process is used in a water cooled mold. The mold is composed of at least two parts and defines a cavity approximating the final outlines of the roll. The mold has tapered transition regions between a part of the cavity corresponding to the barrel and the constricted cavity regions corresponding to the necks. The roll produced in the remelting step is then heat treated and finished.

13 Claims, 1 Drawing Sheet

PROCESS OF PRODUCING A COMPOSITE ROLL

FIELD OF THE INVENTION

The present invention relates to a process of producing a roll, suitable for use in a rolling mill, in which the barrel and the neck of the roll are made of different materials, also known as a composite roll.

TECHNOLOGY REVIEW

Composite rolls are used wherever the requirements for a roll—a high surface hardness and wear resistance in the barrel of the roll, and high fatigue strength to alternating bending stresses in the necks of the roll—cannot be met by a single material.

According to one prior art method, composite rolls are produced in a centrifugal casting process. In composite cast rolls produced according to this method, the core material is composed of alloyed cast iron and the wear resistant layer of the roll barrel is composed of alloys containing a high percentage of chromium. The molten, chromium-rich alloy is cast into a rapidly rotating mold and is thus thrown against the inner wall of the mold. When the intended wall thickness has been reached, the mold is stopped and the remaining cavity is filled with alloyed cast iron. However, such composite rolls have a poorer surface quality than rolls forged of a single material and this has a negative effect on the material being rolled.

Another method involves shrink fitting a forged or cast shell of alloys having a high resistance to abrasive wear onto a forged or cast cylindrical core. However, such a process is very expensive and, in view of the minimum thickness of the shell to be shrink fitted, is applicable only for composite rolls having larger diameters.

British Patent No. 2,036,617 discloses the production of an ingot which varies in chemical composition over its length in that, over parts of its length, an alloying additive is associated with an electrode made of a basic material or a basic alloy. In this case, however, the entire ingot is made of one basic alloy which is merely supplemented locally by additives. Moreover, the mold employed in that process is in no way suitable to produce a composite roll of the type of the present invention.

The objects of the present invention include providing a process for the manufacture of composite rolls which is relatively inexpensive, applicable to a wide range of sizes of rolls and produces rolls with good surface qualities.

SUMMARY OF THE INVENTION

The invention provides a process of manufacturing a roll suitable for use in a rolling mill, the roll having a cylindrical barrel middle section, a neck of smaller diameter than the barrel at each end of the barrel, and a tapered transition region between the barrel and each neck, in which the barrel and necks are of different material compositions. The process involves remelting an electrode having a central region corresponding in mass and composition of materials to that desired for the barrel of the roll, two end regions corresponding in mass and composition of materials to that desired for the necks of the roll and a transition region between the central region and each end region, each transition region including the material of the barrel and at least one further material to increase fracture toughness, for example engineering steel.

An electroslag remelting process is used with a water cooled mold. The mold is composed of at least two parts and defines a cavity approximating the final outlines of the roll. The mold has tapered transition regions between the part of the cavity corresponding to the barrel and the parts of the cavity region corresponding to the necks. The roll produced in the remelting step is then heat treated and finished.

DETAILED DESCRIPTION OF THE INVENTION

The composite roll is formed by remelting an electrode in an electroslag remelting process as disclosed, for example for the production of a homogeneous ingot of a single material in U.S. Pat. No. 2,361,101. By constructing the electrode according to the invention from regions composed of different materials, the roll barrel, the necks and the transition regions can be produced in a single, one-part workpiece, each from a combination of materials which meets the respective requirements. If low-segregation workpieces are produced in an electroslag remelting process, it is desirable to have the lowest possible depth of heel. In addition to the electrical remelting parameters, the heel depth is influenced considerably by the diameter of the mold. Using a mold close to the final outlines, it is now possible to use the smallest possible mold diameter for all regions of the composite roll to thus minimize the heel depth for all regions of the composite roll.

If the barrel of a composite roll produced according to the invention is made of tool steel, for example a steel composed of 0.86–0.94% C, ≦0.45% Si, ≦0.40% Mn, ≦0.030% P, ≦0.030% S, 3.80 to 4.50% Cr, 4.70 to 5.20% Mo, 1.70 to 2.00% V, 6.00 to 6.70% W, balance Fe, it has great hardness, great depth of case and high resistance to abrasive and adhesive wear. If the necks are made of engineering steel, for example, a steel composed of 0.46–0.54% C, ≦0.40% Si, 0.50 to 0.80% Mn, ≦0.035% P, ≦0.030% S, 0.90 to 1.20% Cr, 0.15 to 0.30% Mo, balance Fe, the necks will have a high fatigue strength to alternating bending stresses and will have a high surface hardness. Using the above ratios of materials for the barrel and necks, high fracture toughness can be achieved in the transition regions between neck and barrel.

To avoid stress cracking in the transition regions of the composite roll, the composite roll is advantageously cooled slowly to room temperature in a thermally insulated vessel, after it has been removed from the mold. To achieve high fatigue strength to alternating bending stresses, it is of advantage to perform a heat treatment of solution annealing, with subsequent quenching and at least one subsequent annealing treatment. A high hardness, depth of case and resistance to abrasive and adhesive wear of the barrel are obtained by a heat treatment which includes a salt bath treatment of a temperature from about 1150° C. to about 1250° C. with subsequent quenching and at least one subsequent annealing treatment. The surface hardness of the necks can be improved by an additional heat treatment which can be for example a flame hardening or induction hardening process.

DESCRIPTION OF THE PREFERRED EMBODIMENTS

Figure 1:
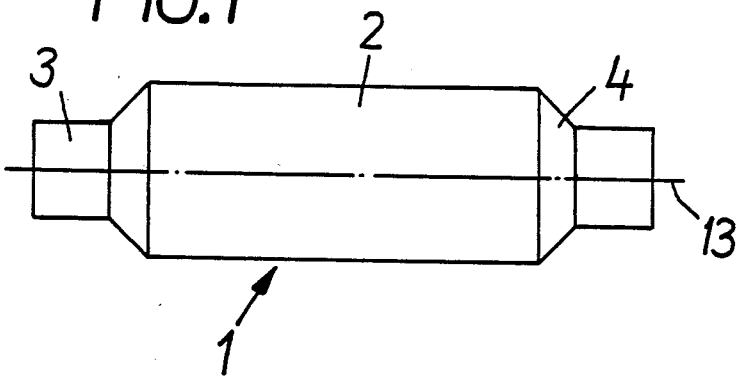
FIG. 1 is an elevation view of a composite roll.
Figure 2:
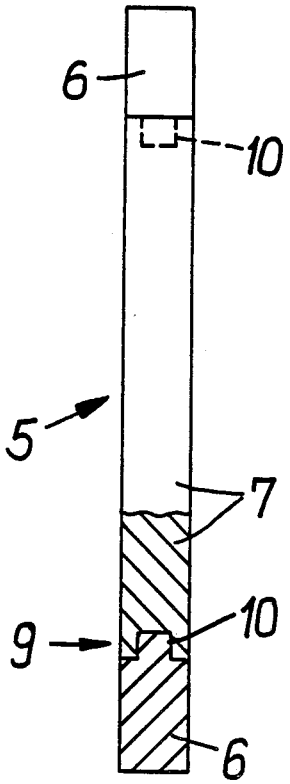
FIG. 2 is a partial sectional view of an electrode suitable for the production of the roll of FIG. 1.

A composite roll 1 to be produced according to the invention (hereinafter also abbreviatedly called "roll") shown in FIG. 1 includes a center portion or barrel 2 and two necks 3 at its ends. A transition region 4 between barrel 2 and each neck 3 has a tapered configuration. Barrel 2 is made of a steel having the following composition:

0.86–0.94% C; 3.80 to 4.50% Cr; ≦0.45% Si; 4.70 to 5.20% Mo; ≦0.40% Mn; 1.70 to 2.00% V; ≦0.030% P; 6.00 to 6.70% W;
≦0.030% S; balance Fe.

(Code No. 1.3343, hereinafter also abbreviated as "WB") and the necks are made of a steel having the following composition:

0.46 to 0.54% C; ≦0.030% S; ≦0.40% Si; 0.90 to 1.20% Cr; 0.50 to 0.80% Mn; 0.15 to 0.30% Mo; ≦0.035% P; balance Fe.

(Code No. 1.7228 hereinafter abbreviated as "WZ").

To produce the composite roll 1, an electrode 5 having regions 6 of WZ material at its ends and a center region 7 of WB material is remelted in a mold 8 using an electroslag remelting process. Between the actual regions 6 and 7 of different materials, electrode 5 has transition regions 9 in which material WB as well as material WZ are present. Material WZ projects in the form of a peg 10 into a respective recess of center region 7 of material WB. The volume ratio of peg 10 to the total volume of transition region 9 permits control of the percentages of material WZ in transition region 9 or 4, respectively. Peg 10 may here be composed wholly or partially of another material.

The mass of region 6 of electrode 5, which is composed of material WZ over its entire cross section, corresponds to the mass of neck 3 of roll 1 plus an amount allowed for machining. The mass of a transition region 9 of electrode 5 in which material WZ as well as material WB are contained corresponds essentially to the mass of transition region 4 from neck 3 to barrel 2 plus an amount allowed for machining, and the mass of center region 7 in which only material WB is present essentially corresponds to the mass of roll barrel 2 plus an amount allowed for machining.

Figure 3:
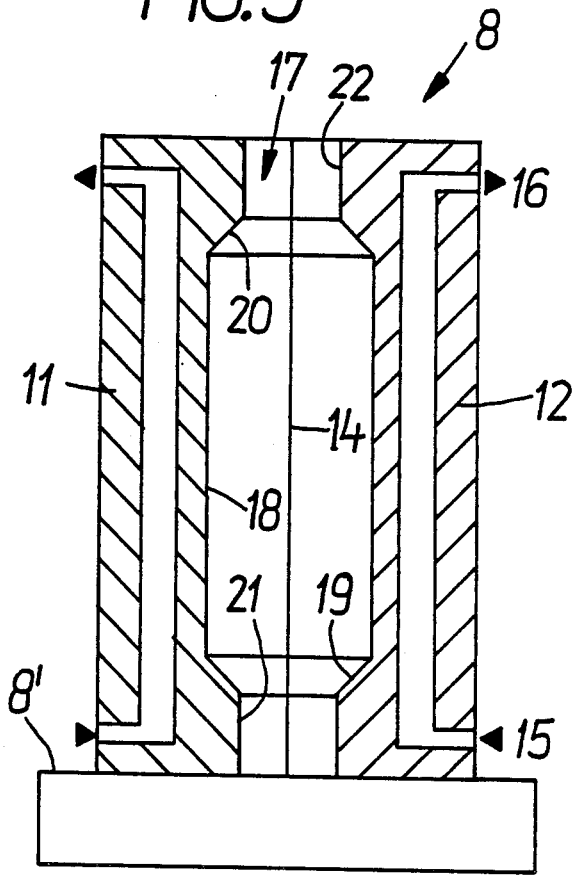
FIG. 3 is a longitudinal sectional view of the mold arrangement.

As shown in FIG.3, mold 8 which stands on a water-cooled bottom plate 8' and in which electrode 5 is remelted, includes two identical parts 11 and 12, each constituting a half of mold 8. During remelting, the center axis of electrode 5 lies in a common contact or parting plane 14 of these mold halves 11 and 12. Each mold half 11 and 12 has a separate coolant inlet 15 and outlet 16. The cavity 17 of mold 8 includes a central cylindrical region 18 with a diameter which corresponds to, after allowing for shrinkage during cooling of the remelted electrode material and after allowing for an amount allowed for machining, the diameter of barrel 2 of roll 1. This central region 18 is followed by respective transition regions 19 and 20 and a constricted lower cavity 21 and a constricted upper cavity 22, respectively. The diameter of cavities 21 and 22 is again dependent upon the diameter of the finished roll neck 3, shrinkage and the amount allowed for machining.

Immediatley after remelting of electrode 5, mold halves 11 and 12 are removed and the still hot composite roll 1 is transported by means of a suitable conveying means (not shown) into a thermally insulated vessel (also not shown) and is there slowly cooled to room temperature.

In a practical embodiment of the process, the materials had the following chemical composition by mass percent of the respective elements:

Material WB (Code No. 1.3343)

0.9% C, 4.9% Mo,
0.4% Si, 1.9% V,
0.36% Mn, 6.4% W,
4.1% Cr, balance Fe.

Material WZ (Code No. 1.7228)

0.49% C, 1.33% Cr,
0.26% Si, 0.25% Mo,
0.82% Mn, balance Fe.

After cooling, composite roll 1 was heat treated in the following partial steps:

1. (a) heating the composite roll to 850° C., holding at this temperature for 3 hours and subsequent cooling in oil;

(b) heating to 560° C., holding at this temperature for 24 hours and subsequent cooling in air;

2. (a) heating to 400° C. in a hot air furnace;

(b) heating to 860° C. in a salt bath and holding at this temperature for 30 minutes;

(c) heating to 1230° C. in the salt bath, holding at this temperature for 15 minutes and subsequent cooling in the salt bath to 450° C. and then cooling in air after removal from the salt bath;

(d) annealing three times at 540° C. with subsequent cooling in air each time;

3. (a) flame hardening of the necks at 860° C. and cooling with water while roll advances axially;

(b) annealing at 360° C. with a burner and subsequent cooling in a stream of air while roll advances axially.

With the described heat treatment, the following hardness values were obtained for composite roll 1:

neck 3: 60 HRC
roll barrel 2; 65 HRC
transition regions 4; 40 HRC
HRC=hardness in Rockwell units While roll necks 3 were rough-machined before the described heat treatment, the composite roll as a whole was finished by grinding after the described heat treatment.

A composite roll produced in this manner is particularly suitable for use as a work roll in a multi-roll stand (so-called Z-high technology). Further uses are as an S-shaped cambered work roll in cold-reduction mills (CVC technology) and as a working or intermediate roll in a cold-reduction multi-roll mill (6-high technology).

It will be understood that the above description of the present invention is susceptible to various modifications, changes and adaptations, and the same are intended to be comprehended within the meaning and range of equivalents of the appended claims.

What is claimed is:

1. A process of manufacturing a composite roll for use in a rolling mill, said roll having a cylindrical barrel middle section, a cylindrical neck of smaller diameter than the barrel at each end of the barrel, and a tapered transition region between the barrel and each neck, the barrel and necks having different material compositions, comprising the steps of:

constructing a unitary composite electrode comprising a central region with two ends containing in mass and composition the materials for the barrel of the roll, two end regions containing in mass and composition the materials for the necks of the roll associated with one end each of said central region and a transition region between the central region and each end region, the transition regions comprising the material of the barrel and at least one further material;

melting said unitary composite electrode in a water cooled mold, said mold being composed of a plurality of parts and defining a cavity approximating the final outlines of the roll, said mold having tapered transition regions between a part of said cavity corresponding to the barrel and constricted cavity regions corresponding to the necks to form a composite roll;

heat treating the roll produced in the melting step to produce a heat treated roll; and finishing the heat treated roll to produce a composite roll for use in a rolling mill.

2. A process as defined in claim 1, wherein each transition region of the electrode includes the material of the necks.

3. A process as defined in claim 1, wherein the central region of the electrode corresponding to the barrel of the roll is composed of tool steel.

4. A process as defined in claim 3, wherein the central region of the electrode corresponding to the barrel is made of a steel composed of 0.86–0.94% C, ≦0.45% Si, ≦0.40% Mn, ≦0.030% P, ≦0.030% S, 3.80 to 4.50% Cr, 4.70 to 5.20% Mo, 1.70 to 2.00% V, 6.00 to 6.70% W, balance Fe.

5. A process as defined in claim 1, wherein the end regions of the electrode corresponding to the necks are made of engineering steel.

6. A process as defined in claim 5, wherein the end regions of the electrode corresponding to the necks are made of a steel composed of 0.46 to 0.54% C, ≦0.40% Si, 0.50 to 0.80% Mn, ≦0.035% P, ≦0.030% S, 0.90 to 1.20% Cr, 0.15 to 0.30% Mo, balance Fe.

7. A process as defined in claim 1, further comprising the steps of removing the parts of the mold from the roll immediately after the remelting step and cooling the roll slowly to room temperature in a thermally insulated container.

8. A process as defined in claim 1, wherein the heat treatment for the roll includes the steps of solution annealing with subsequent quenching and at least one subsequent annealing treatment.

9. A process as defined in claim 1, wherein the heat treatment for the roll includes the steps of a salt bath treatment at temperatures of 1150° to 1250° C. with subsequent quenching and at least one subsequent annealing treatment.

10. A process as defined in claim 1, wherein the heat treatment includes the step of hardening the necks.

11. A process as defined in claim 10, wherein the necks are hardened by flame hardening.

12. A process as defined in claim 10, wherein the necks are hardened by induction hardening.

13. A process as defined in claim 1, wherein the step of finishing the roll is performed by grinding.

* * * * *